US007618213B2

(12) United States Patent
Durkheim

(10) Patent No.: US 7,618,213 B2
(45) Date of Patent: Nov. 17, 2009

(54) DRAINAGE GEOCOMPOSITE AND ITS METHOD OF MANUFACTURE

(75) Inventor: Yves Durkheim, Chartres (FR)

(73) Assignee: Afitex International SAS, Chartres (FR)

( * ) Notice: Subject to any disclaimer, the term of this patent is extended or adjusted under 35 U.S.C. 154(b) by 70 days.

(21) Appl. No.: 11/631,975

(22) PCT Filed: Jun. 29, 2005

(86) PCT No.: PCT/FR2005/001654

§ 371 (c)(1),
(2), (4) Date: Aug. 30, 2007

(87) PCT Pub. No.: WO2006/030076

PCT Pub. Date: Mar. 23, 2006

(65) Prior Publication Data

US 2008/0075536 A1 Mar. 27, 2008

(30) Foreign Application Priority Data

Jul. 9, 2004 (FR) ..... 04 07701

(51) Int. Cl.
*E02B 11/00* (2006.01)

(52) U.S. Cl. ..... 405/49; 405/43; 405/44; 405/45; 405/50

(58) Field of Classification Search ..... 405/43–45, 405/50, 38, 36, 49
See application file for complete search history.

(56) References Cited

U.S. PATENT DOCUMENTS

| | | | | |
|---|---|---|---|---|
| 4,490,072 | A * | 12/1984 | Glasser | 405/45 |
| 5,475,904 | A | 12/1995 | Le Roy et al. | |
| 6,312,190 | B1 * | 11/2001 | Goughnour | 405/36 |
| 6,315,493 | B2 * | 11/2001 | Malone et al. | 405/45 |
| 6,648,550 | B1 * | 11/2003 | Parker | 405/50 |
| 6,702,517 | B2 * | 3/2004 | Goddard | 405/45 |
| 7,465,390 | B2 * | 12/2008 | Potts | 405/45 |

FOREIGN PATENT DOCUMENTS

| | | |
|---|---|---|
| EP | 0 962 754 A | 12/1999 |
| FR | 2 746 424 A | 9/1997 |

* cited by examiner

*Primary Examiner*—Frederick L Lagman
(74) *Attorney, Agent, or Firm*—Sughrue Mion, PLLC

(57) ABSTRACT

This invention concerns a geocomposite (1, 2) that includes a drainage sheet (4) onto which are placed perforated, girdled mini-drains (5) parallel to each other, and at least one filtration sheet (31) covering the perforated, girdled mini-drains (5), characterized in that the drainage sheets (4) and the filtration sheets are connected together by the needlepunching technique.

10 Claims, 4 Drawing Sheets

DRAINAGE GEOCOMPOSITE AND ITS METHOD OF MANUFACTURE

BACKGROUND OF THE INVENTION

This present invention concerns a drainage geocomposite applied, for example, to drainage of the ground or of civil engineering creations, and its method of manufacture.

Previous designs have included various geocomposite materials intended for drainage of the ground or of civil engineering creations. Such materials are composed of draining geotextiles that frequently include a geo-spacer with the whole maintained between two sheets of filtering geotextiles. In this present case, the geo-spacer is composed of either girdled and perforated tubes, or of helical springs or of an tube equipped with fins, thus providing continuous passages for drainage of the interstitial water.

The geocomposite can be composed of a filtration sheet and a drainage sheet, with the geo-spacer most often located in a gusset between the two sheets. The sheets, both drainage and filtration, are created from non-woven fibres and are then joined together either by glueing or by lines of stitching that run the length of the geo-spacers in order to create the geocomposite.

Since assembly by glueing can alter the filtration qualities of the geomaterial, certain geocomposites are assembled by means of the needlepunching method.

A variant of this method is described in patent U.S. Pat. No. 5,475,904, where this method includes several stages, namely a stage for assembly of two compounds (a drainage sheet and a filtration sheet, for example), a stage in which the compounds are then conveyed to the needlepunching machine, and then a stage in which they are joined together. A space is created between the two compounds in order to be able to insert other materials after needlepunching, in particular liquids which will then be hardened.

Patents FR 2 746 424 and EP 0 962 754 describe geotextiles that have at least one filtration sheet and at least one drainage sheet, assembled by this needlepunching method. In the case of patent EP 0 962 754, a network of electrodes is placed between the two sheets. For patent FR 2 746 424, these are drains perforated uniformly all around periphery of the rings that are inserted between the two sheets.

Such creations nevertheless have certain drawbacks. In fact, the geomaterials created using the aforementioned techniques can have a low resistance to internal shear forces thereby limiting their use to flat or slightly sloping surfaces. In addition, the creations in which the sheets are glued or stitched together do not result in a geomaterial with a uniform and constant porosity, since the inter-sheet connections are not homogeneous, in particular regarding the stitching or the glueing. The multiplication of the stages in certain cases further complicates these techniques. Finally, the uniform perforation of the drains does not allow removal of the interstitial water when the materials have been subjected to compressive forces.

BRIEF SUMMARY OF THE INVENTION

The purpose of the present invention is therefore to overcome some drawbacks of the prior art by proposing a geocomposite that has a resistance to internal shear forces, so that it can be used for the drainage of sloping ground, in which the filtration surfaces have a uniform and constant porosity and in which the filtration quality is not altered.

This objective is attained by a method for the manufacture of a geocomposite that includes a drainage sheet on which are placed perforated, girdled mini-drains parallel to each other, and at least one filtration sheet covering the mini-drains, characterized in that:

- in a first stage, the various components are superimposed as indicated previously,
- in a second stage, the components thus superimposed are conveyed by means of conveyance devices to a needlepunching machine,
- in a third stage, the components are joined together by needlepunching.

This objective is also attained by a geocomposite that includes a drainage sheet on which are placed perforated, girdled mini-drains parallel to each other, and at least one filtration sheet covering the perforated, girdled mini-drains, characterized in that the drainage sheet and the filtration sheets are connected together by the needlepunching technique.

According to another particular feature, assembly of the various component elements is effected by simultaneous passage of these different components in a needlepunching machine.

According to another particular feature, the sheets constituting the geocomposite are manufactured using the non-woven needlepunched technique.

According to another particular feature, the girdled mini-drains are perforated along two axes alternating at approximately 90°.

According to another particular feature, each groove of a mini-drain is equipped with two diametrically opposing perforations.

According to another particular feature, the mini-drains are located in spaces created between the needlepunched parts of the drainage sheet and at least one filtration sheet.

According to another particular feature, the material is composed of a filtration sheet on which the drainage sheet assembly, the mini-drains and the filtration sheet are fixed.

According to another particular feature, the materials constituting the various component elements are rot-proof materials.

According to another particular feature of the method of manufacture, spaces are created in the needle-plate of the needlepunching machine allowing the passage of the pipes.

According to another particular feature of the method of manufacture, the needlepunching machine is a single-strike machine.

BRIEF DESCRIPTION OF THE DRAWINGS

Other particular features and advantages of this present invention will become readily apparent when reading the description that follows, given with reference to the appended drawings, in which.

Figure 1A:
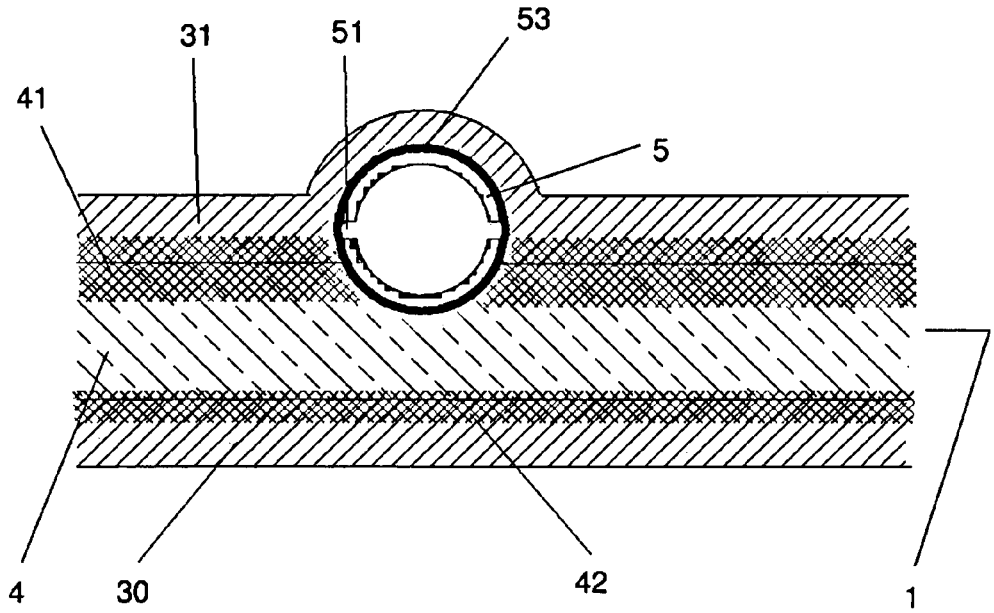
FIG. 1*a* represents a view in section of the geomaterial according to a first embodiment of the invention.
Figure 1B:
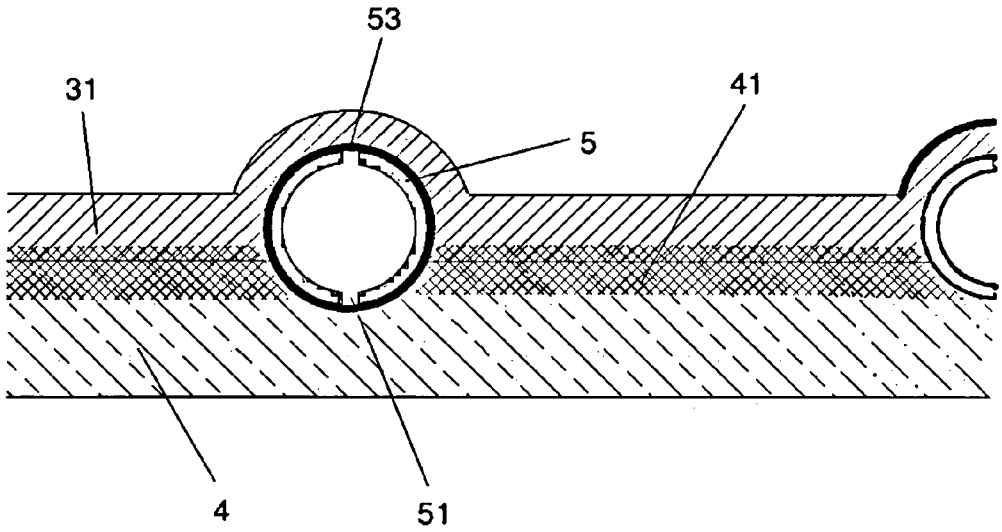
FIG. 1*b* represents a view in section of the geomaterial according to a second embodiment of the invention.
Figure 2:
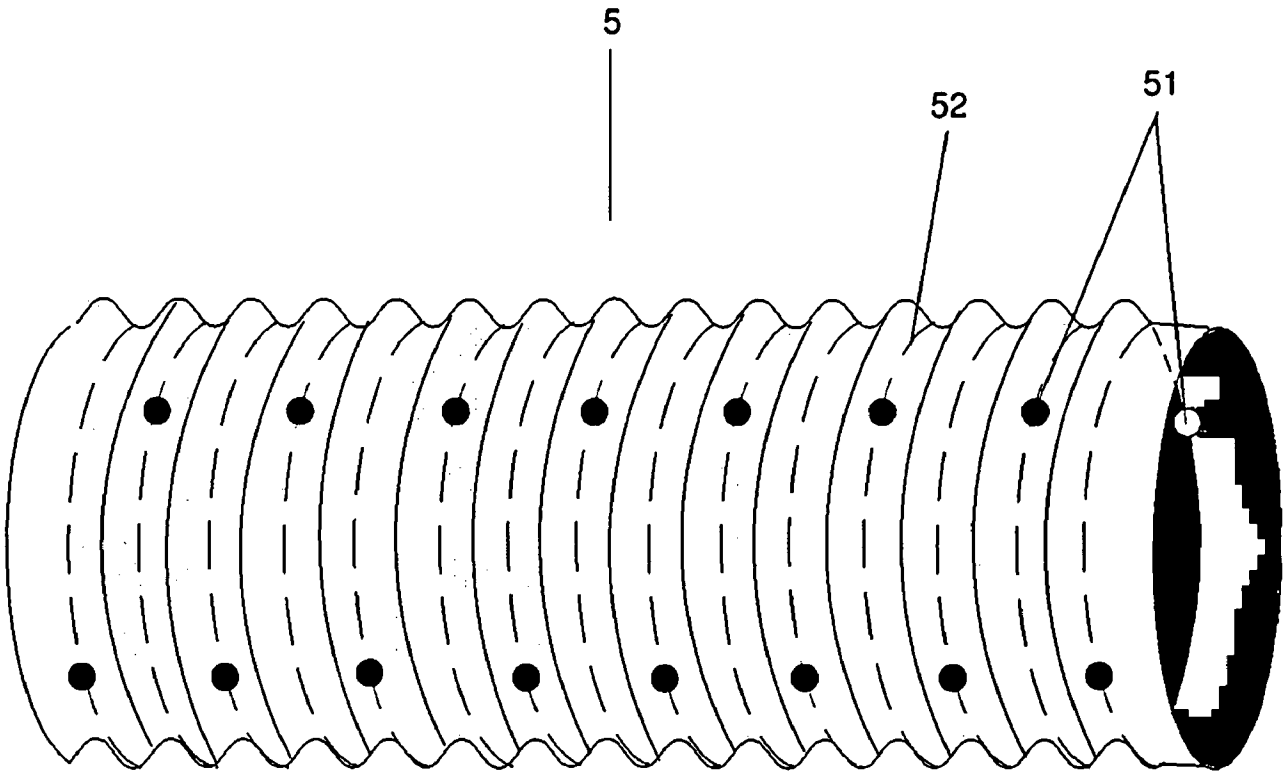
FIG. 2 represents a general view of a drain used in the geomaterials of the invention, FIG. 3 schematically represents the machine, which is used to create the material of the invention.
Figure 3:
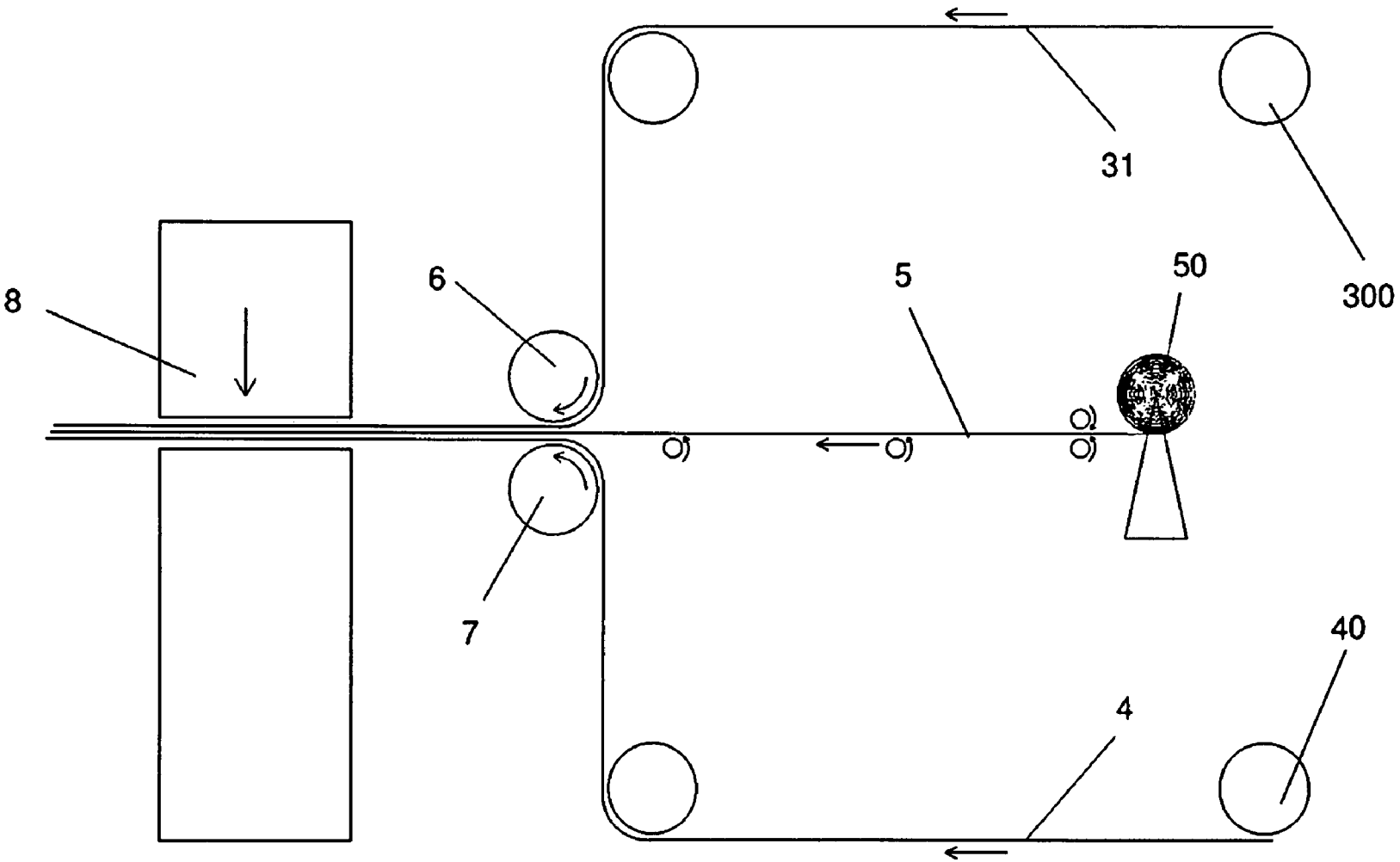
Figure 4A:
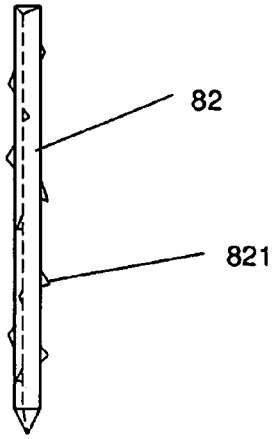
FIG. 4*a* is an enlarged view of a needle of the needlepunching machine of the invention.
Figure 4B:
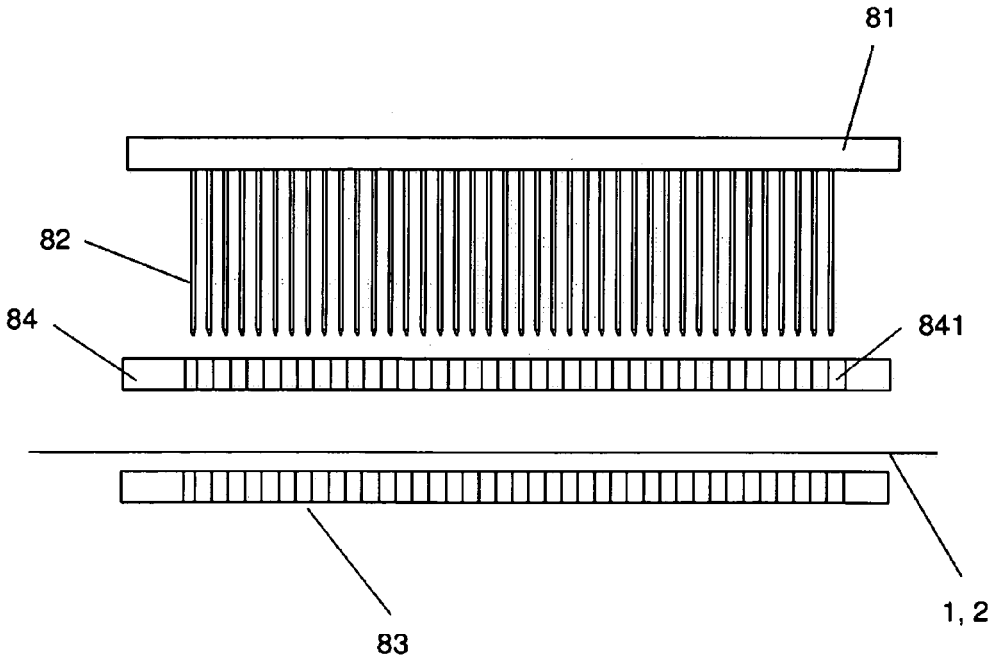
FIG. 4*b* represents a view in section of the component parts of the needlepunching machine of the invention.

The invention concerns a geocomposite composed of at least two sheets which have essentially different hydraulic and mechanical properties, and a multiplicity of geo-spacers, as well as its method of manufacture.

In a first embodiment of the invention; the geocomposite (1) is composed of a first sheet with filtration properties (30), where this sheet is of the non-woven, needlepunched type. Onto this sheet is fixed a sheet with drainage properties (4), which is also of the non-woven, needlepunched type. The two filtration (30) and drainage (4) sheets are connected together by the needlepunching technique (42). Onto this drainage sheet (4), are placed, parallel to each other, at distances chosen according to the intended use of the geomaterial, girdled mini-drains (5) which are perforated along two axes alternating at approximately 90°. Each groove (52) of a mini-drain (5) is equipped with two diametrically opposing perforations (51). This layer of mini-drains (5) is covered with a filtration sheet (31) of the non-woven, needlepunched type. The mini-drains (5) are resistant to compression, which means that the water can always be removed even when the geomaterial (1) is buried in the ground. The filtration sheet (31) and the drainage sheet (4) are also connected together by the needlepunching technique (41). However, during the needlepunching of these two sheets (31, 4), spaces (53) are created in which the mini-drains (5) are located. The mini-drains (5) are therefore connected to the structure of the geomaterial (1), since they are established between the drainage (4) and filtration (31) sheets during the needlepunching process.

In a second embodiment of the invention, the geocomposite (2) is composed of a first sheet with drainage properties (4), where this sheet (4) is of the non-woven, needlepunched type. Onto this drainage sheet (4) are placed girdled mini-drains (5), parallel to each other, at distances chosen according to the intended use of the geomaterial (2). This layer of mini-drains (5) is covered with a filtration sheet (31), which is also of the non-woven, needlepunched type. The drainage sheet (4) and the filtration sheet (31) are connected together by the needlepunching technique (42). However, during the needlepunching of the two sheets (4, 31) constituting the geomaterial (2), spaces (53) are created in which the mini-drains (5) are located.

The different elements (30, 4, 5, 31) making up the geocomposite (1, 2) according to any of the methods of implementation of the invention are composed of rot-proof materials, like polypropylene for example.

The filtration sheets have as their objective to protect the drainage sheet (4) from being clogged by fines particles. Such sheets therefore have a porosity that is appropriate to this function, just as the drainage sheet has a porosity to suit its function.

Assembly of the various elements (30, 4, 5, 31) making up the geocomposite (1, 2) of the invention is effected by simultaneous passage of these different components (30, 4, 5, 31) in a machine that is equipped for this purpose, in order to simplify the manufacture of the product. In fact, the method of assembly consists of conveying the different components (4, 5, 31) of the material of the invention from their respective rolls (40, 50, 300). These different components are superimposed as indicated previously, with sets of pipes (5) spaced on the drainage sheet (4), and the filtration sheet (31) on the sets of space pipes (5), and the drainage sheet (4). The different components thus superimposed are then conveyed together by a set of conveyance devices (6, 7) to the needlepunching machine (8).

The needlepunching machine (8) consists of a needle-plate (81) equipped with a multiplicity of needles (82). Each needle (82) has a triangular section and is equipped with hooks (821). These hooks (821) are used to cause the fibres making up the different sheets to knit together in order to create the connection between the sheets.

To effect the needlepunching process, the needles (82) of the needle-plate (81) have to be forced into the sheets to be joined. The needles (82) are guided by a cleaner plate (84), which is a part pierced with holes (841) allowing the needles (82) to pass, and to traverse the various layers of textile until they interleave in a part called the anvil (83), The needlepunching machine (8) is known as the single-strike type, since only one needle-plate (81) is used in the needlepunching process. The anvil (83) includes lamella or blades (831) which separate the different rows of needles (82). Zones without needles (811), whose width corresponds to the diameter of the pipes, are created in the needle-plate (81) in order to allow the passage of the pipes (5) so that they will not be needlepunched and damaged.

The cleaner plate (84) holds the textile sheets intact during the return phase of the needles.

The inter-sheet connection effected by the needlepunching process endows the geocomposite (1, 2) of the invention with several qualities. In fact, this method of assembly of the sheets provides a geocomposite that has a resistance to quite high internal shear forces. This resistance is such that the geomaterial (1, 2) of the invention can be used for the drainage of sloping ground. Assembly by needlepunching also provides a geomaterial whose filtration surfaces have a uniform and constant porosity. A geomaterial whose connections are created by needlepunching has a high degree of structural solidity in use, since the stresses to which it is subjected are applied to the whole of its structure and not just to a few specific points of the structure. Finally, the filtration quality of the geomaterial is not altered, as is the case with connection by glueing or stitching.

In a variant of implementation, the needlepunching machine (8) can be of the double-strike type, with two needle plates (81), facing each other and interleaved.

It should be obvious to those skilled in the art that the present invention allows embodiments in many other specific forms while still not moving outside the scope of the invention as claimed. As a consequence, the present embodiments should be considered as illustrations only, capable of being modified within the area determined by the scope of the attached claims, and the invention should not be limited to the details given above.

The invention claimed is:

1. A method for the manufacture of a geocomposite (1,2) that includes a drainage sheet (4) on which are placed perforated, girdled mini-drains (5) parallel to each other, and at least one filtration sheet (31) covering said mini-drains, characterized in that the method includes:

a first step of superimposition of the following components (4, 5, 31):

at least one drainage sheet, girdled mini-drains that include two series of perforations created with an offsetting groove, a first series of two diametrically opposing perforations created in every two grooves, a second series of two diametrically opposing perforations created in every two grooves offset by 90 degrees in relation to the first series;

at least one filtration sheet, a second step of conveyance of the components thus superimposed by means of conveyance devices (6, 7) to a needlepunching machine (8) in which needle plate (81) includes spaces (811) allowing the passage of the mini-drains (5), a third step for joining together of the components by needlepunching.

2. A method for the manufacture of a geocomposite (1, 2) according to claim 1, comprising an additional preliminary step for the joining together of a second filtration sheet with the drainage sheet.

3. A method for the manufacture of a geocomposite (1, 2) according to claim 1, wherein the needlepunching is performed by a single-strike machine.

4. A geocomposite (1, 2) that includes a drainage sheet (4) on which perforated, girdled mini-drains (5) are placed parallel to each other, and at least one filtration sheet (31) covering the perforated, girdled mini-drains (5), characterized in that the girdled mini-drains include two series of perforations created with an offsetting groove, a first series of two diametrically opposing perforations created in every two grooves, a second series of two diametrically opposing perforations is created in every two grooves with an offset of 90 degrees in relation to the first series.

5. A geocomposite (1, 2) according to claim 4, wherein the different components of the geocomposite are joined together by the needlepunching technique.

6. A geocomposite (1, 2) according to claim 4, wherein assembly of the various component elements (30, 4, 5, 31) is effected by simultaneous passage of these different components in a needlepunching machine.

7. A geocomposite (1, 2) according to claim 4, wherein the sheets constituting the geocomposite (1, 2) are manufactured according to a technique of the non-woven, needlepunched type.

8. A geocomposite (1, 2) according to claim 4, wherein the mini-drains (5) are located in spaces (53) created between the needlepunched parts of the drainage sheet and at least one filtration sheet (31).

9. A geocomposite (1, 2) according to claim 4, comprising a filtration sheet (31) onto which is fixed the drainage sheet (4), mini-drains (5) and filtration sheet (30) assembly.

10. A geocomposite (1, 2) according to claim 4, wherein the materials making up the various component elements (30, 4, 5, 31) are rot-proof materials.

* * * * *